US005755418A

United States Patent [19]

Kracke et al.

[11] Patent Number: 5,755,418

[45] Date of Patent: May 26, 1998

[54] INVERTED CONTAINER HOLDER

[76] Inventors: David R. Kracke, 2155 NE. 79th, Portland, Oreg. 97213; Robert W. DeLorenzo, 29438 Stonecrest Rd., Rancho Palos Verdes, Calif. 90275

[21] Appl. No.: 720,113

[22] Filed: Sep. 27, 1996

Related U.S. Application Data

[63] Continuation of Ser. No. 372,815, Dec. 23, 1994, abandoned.

[51] Int. Cl.[6] ..... A47K 1/08

[52] U.S. Cl. ..... 248/311.3; 211/74

[58] Field of Search ..... 248/311.3, 311.2, 248/312, 314, 346.11, 310, 346.5, 519; 211/74, 75

[56] References Cited

U.S. PATENT DOCUMENTS

| | | | |
|---|---|---|---|
| 493,161 | 3/1893 | Grau | 248/314 |
| 2,211,746 | 8/1940 | Young | 248/311.2 |
| 2,784,577 | 3/1957 | Beaham, III | 248/346.11 X |
| 3,731,819 | 5/1973 | Sandhage | 211/74 |
| 4,026,508 | 5/1977 | Ziegler | 248/314 X |
| 4,271,878 | 6/1981 | Belega | 248/311.3 X |
| 4,347,879 | 9/1982 | Blaser | 211/74 X |
| 4,795,211 | 1/1989 | Stern et al. | 297/194 |
| 4,854,468 | 8/1989 | Dahlquist, II et al. | 220/85 H |
| 4,960,254 | 10/1990 | Hartke | 248/146 |
| 4,971,209 | 11/1990 | Todd | 211/74 |
| 5,065,966 | 11/1991 | Hartke | 248/146 |
| 5,071,002 | 12/1991 | Bradley | 206/217 |
| 5,078,346 | 1/1992 | Deichman | 248/351 |
| 5,088,673 | 2/1992 | Chandler | 248/311.2 |
| 5,141,194 | 8/1992 | Burgess et al. | 248/311.2 |
| 5,149,041 | 9/1992 | Hartke | 248/146 |
| 5,174,534 | 12/1992 | Mitchell | 248/311.2 |
| 5,199,681 | 4/1993 | Reidy | 248/488 |
| 5,439,193 | 8/1995 | Coulter et al. | 248/311.3 X |

*Primary Examiner*—Ramon O. Ramirez
*Assistant Examiner*—Anita M. King
*Attorney, Agent, or Firm*—Kolisch, Hartwell, Dickinson, McCormack & Heuser

[57] ABSTRACT

A device for holding an inverted bottle or container is described. The device includes a cylindrically shaped tube with an outer wall of consistent diameter in the upward direction. The vessel may have ridges on an internal side to engage the top of an inverted container and to securely hold the container in an inverted position, allowing remaining material in the container to move by gravity to the container opening. The vessel is connected to a stabilizing structure or base in order to prevent the vessel form tipping over when loaded with a top heavy inverted container. The device is particularly useful for allowing extrication of remaining material from a nearly empty container, particularly relatively viscous material which is necessarily refrigerated.

7 Claims, 2 Drawing Sheets

INVERTED CONTAINER HOLDER

CROSS-REFERENCE TO RELATED APPLICATIONS

This application is a continuation of U.S. patent application Ser. No. 08/372,815, filed on Dec. 23, 1994 now abandoned.

FIELD OF THE INVENTION

The present invention is a holder for inverted bottles and containers that allows bottles and containers to be stabilized when placed in an inverted position.

BACKGROUND OF THE INVENTION

The present invention addresses the problem of what to do when a bottle or container containing some useful product has been nearly depleted of that product whereby the product itself is located at the very bottom of the container or bottle when that container or bottle is standing on its base.

For example, a consumer purchases a bottle of salad dressing. After almost all of the salad dressing has been used, there still remains some salad dressing at the bottom of the bottle. The salad dressing remaining at the bottom of the bottle is extremely difficult and painstakingly slow to extricate from the bottle. Often times this last remaining salad dressing is thrown away by the consumer due to the difficulty in extricating it from the bottle.

The determined consumer will often balance the bottle on its top (inverted position) within the refrigerator or other area where the bottle is normally stored. However, a basic problem with the inversion technique results from the fact that bottle/containers are designed to be maximally stable in their upright position, i.e., to have a low center of gravity. Therefore, the bottle/containers inherently have high centers of gravity when inverted, and are thus unstable or prone to fall over. Because the bottles are generally shaped with a large base and a small head, this balancing act becomes precarious. The bottle itself often times falls over in the refrigerator or other storage area, knocking other items over in that storage area, and causing a general headache to the consumer. To prevent the bottle from falling over, the consumer will often times situate the bottle or container so that it is squeezed between other items within the storage area causing those other items to act as a brace for the inverted bottle or container.

Accordingly, an object of the present invention is to provide a device which allows a container with a relatively high center of gravity to be securely supported in an inverted position.

Another object is to provide a device which simplifies the process of removing remaining material from a nearly empty container.

Another object is to minimize spills, waste and complications which typically occur in the process of attempting to remove the last remaining material from a nearly empty container, particularly containers which hold typically refrigerated relatively viscous materials.

SUMMARY OF THE INVENTION

The above-stated objects can be accomplished with an inverted container holder including a hollow cylindrically shaped tube secured to a round base piece. In a preferred embodiment, the diameter of the base is approximately twice the diameter of the tube, thereby providing stability when an inverted bottle is placed into the holder. The height of the tube is approximately one and one half times its diameter.

DETAILED DESCRIPTION OF THE DRAWINGS

Figure 1:
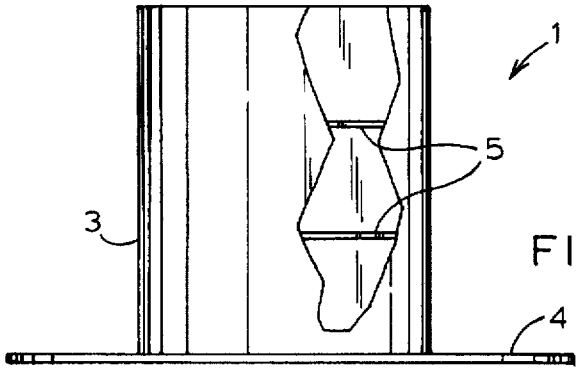
FIG. 1 is a side view of a holder for inverted bottles/containers in accordance with the present invention.
Figure 2:
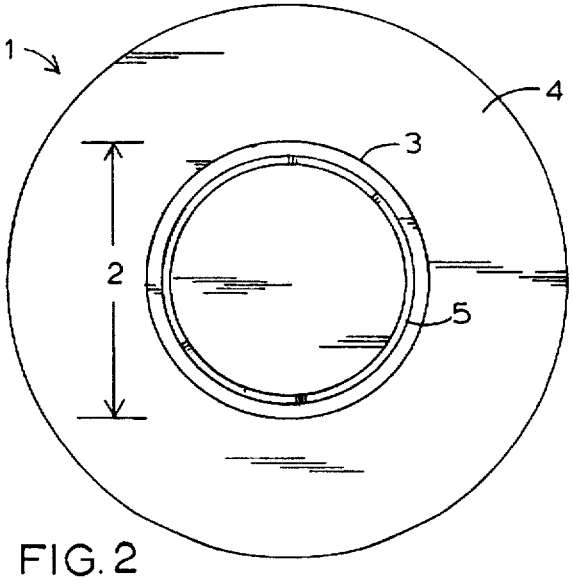
FIG. 2 is a top view of the holder shown in FIG. 1.

With reference to FIGS. 1 and 2 which are overall drawings of a preferred embodiment of the invention, a holder for inverted bottles/containers 1 of the present invention includes a hollow conical shaped piece (or tube) 3 mounted on top of a round base 4. The diameter 2 of tube 3 is approximately one half of the diameter of base 4. For purposes of illustration, these drawings show a holder for inverted bottles and containers whose tube is two inches in diameter and whose base is four inches in diameter with a cylindrical height of two and one half inches. Tube 3 may include internal ridge lines 5 that protrude from its interior surface approximately one eighth of an inch at intervals of approximately one half inch from the top of the cylindrical piece 3 to the base 4.

Figure 4:
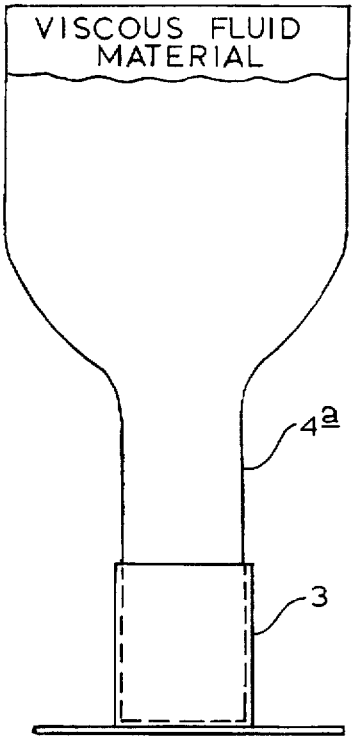
FIG. 4 is a perspective view of an inverted container in a holder.
Figure 3:
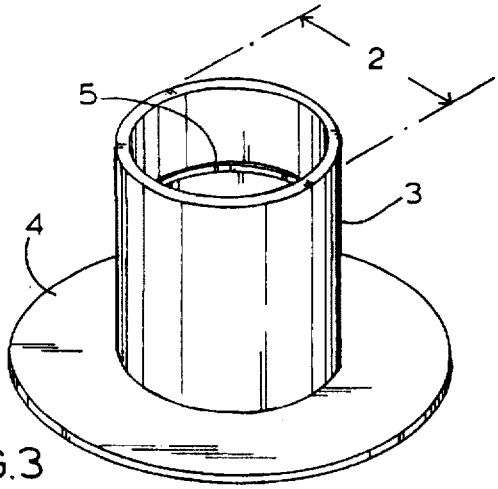
FIG. 3 is a perspective view of the holder shown in FIGS. 1 and 2.
Figure 5:
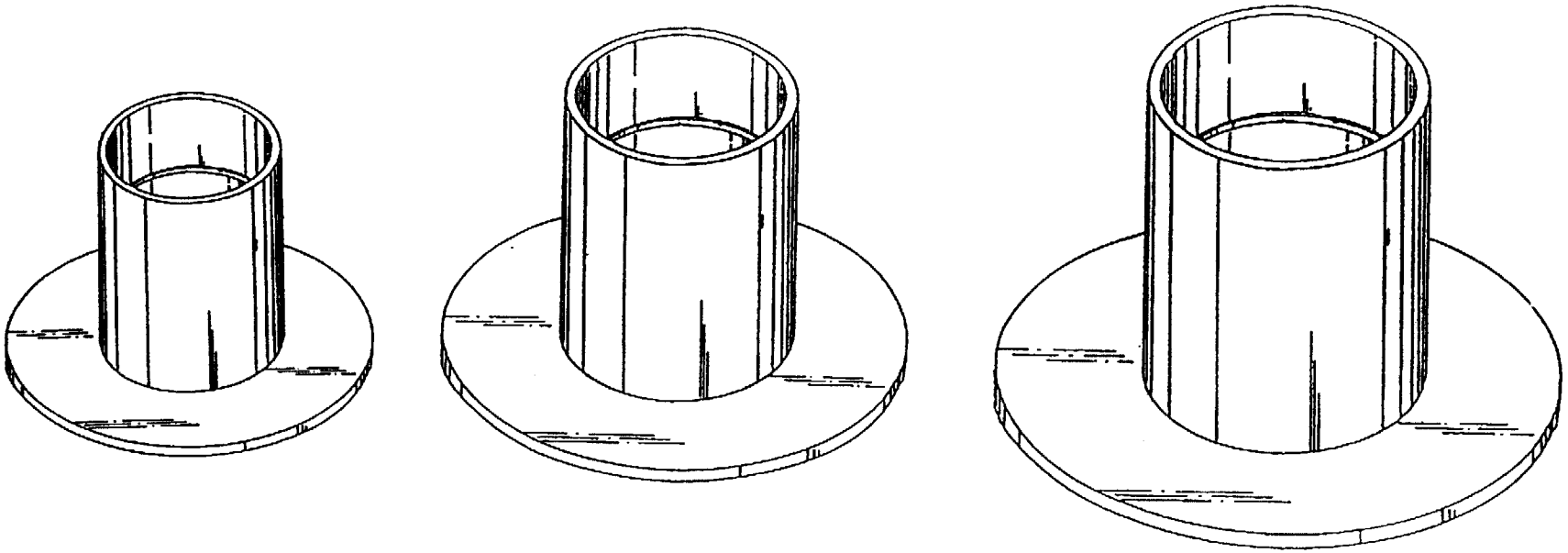
FIG. 5 is a perspective view of a set of inverted container holders in accordance with the present invention.

The opening of the cylindrical piece 3 is dimensioned for receiving inverted bottles/containers. For example, a salad dressing bottle 4*a* as shown in FIG. 4, can be inserted into the opening at the top of the cylindrical piece 3 with the head of the salad dressing bottle eventually resting on the base 4 and surrounded by the cylindrical piece 3. The salad dressing bottle is then held securely in an inverted position by ridges 5 and by the wall of tube 3. This allows the remaining contents thereof to be conveniently extricated from the salad dressing bottle when so desired by the consumer by virtue of the fact that in an inverted position the remaining salad dressing will collect in the top of the salad dressing bottle.

Numerous factors are important to consider in determining the inverted container holder configuration. For example, bottles come in many different sizes. Therefore, the holder should be dimensioned in such a way that it can accommodate as many different container shapes and sizes as possible. Also, refrigerator space is often quite limited. Therefore, the holder should be no larger than necessary and should not significantly elevate the bottle above its normal height. Further, the holder should support a bottle in a position where the center of gravity is as low as possible, i.e., therefore more stable. The holder should also be as manufacturable and simple in design as possible. The holder preferably does not require complex molds or custom fabricated pieces. Additionally, the holder should be made of a material and in a design which is easy to clean. Finally, it is essential that the holder provide adequate stability for an inverted bottle/container which has a center of gravity significantly above the top of the holder, and that the holder be able to maintain the inverted position of the bottle/container notwithstanding moderate lateral blows or forces applied from any side.

With these considerations in mind, we have experimentally determined that the following configuration ranges and ratios should be employed. The tube should have a diameter in the range of about X to about to 5/4X while the tube has a height in the range of about X to 3/2X and the base has a diameter in the range of about 7/4X to 2X. In a preferred embodiment X=2 inches.

Another embodiment of the invention includes a set of inverted container holders, each holder having dimensions in the ranges stated above. In a first holder of the set, $X=X_1$. In a second holder of the set, $X=X_2$. In a preferred embodiment, the ratio of $X_1:X_2$ is approximately 9:5. This set of container holders provides the user with versatility for accommodating a wider range of bottle/container sizes. It is also sometimes useful to provide a third holder in the set for which $X=X_1$.

The invention may be embodied in other specific forms without departing from the spirit or the essential characteristics thereof The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A holding device comprising a base having a top surface, a tube having a circular wall and a bottom edge joined to the top surface of the base, the tube being centrally positioned on the top surface of the base, wherein the base has a minimum diameter large enough to stabilize the tube in an erect position when holding an object with a high center of gravity, without extra weight being added to the base or relying on any anchoring mechanism of the base wherein the tube has inner and outer surfaces forming a substantially constant cross-sectional shape throughout its axial length and at least one circular ridge line located along the length of the inner surface of said tube for accommodating different containers, and a mostly empty container having an openable top and a bottom, the container being held securely in an inverted position by the tube wherein the container contains some viscous material and has a center of gravity significantly above the top of the tube so that the viscous material can migrate by gravitational force from the bottom of the container toward the openable top.

2. The device of claim 1 wherein the base is circular.

3. The device of claim 1 wherein the base is square.

4. The device of claim 1 wherein: (a) the tube has a diameter in the range of about X to 5/4X (b) the tube has a height in the range of about X to 3/2X, and (c) the base has a diameter in the range of about 7/4X to 2X.

5. The device of claim 1 wherein X=2 inches.

6. A set of devices for holding inverted containers comprising:

a first device, as recited in claim 4, for which $X=X_1$; and a second device, as recited in claim 4, for which $X=X_2$, wherein the ratio of $X_1:X_2$ is approximately 9:5.

7. The set of devices of claim 6 further comprising a third device, as recited in claim 4, for which $X=X_1$.

* * * * *